US005229010A

United States Patent [19]

Fluchel

[11] Patent Number: 5,229,010

[45] Date of Patent: Jul. 20, 1993

[54] ROTATING MICROWAVE CONTAMINATED MATERIALS TREATING APPARATUS AND METHOD OF USING THEREOF

[75] Inventor: Donald G. Fluchel, St. Louis, Mo.

[73] Assignee: Progressive Recovery, Inc., Dupo, Ill.

[21] Appl. No.: 724,219

[22] Filed: Jul. 1, 1991

[51] Int. Cl.[5] ..... F26B 3/347

[52] U.S. Cl. ..... 210/748; 34/1 P; 34/1 T; 210/180; 210/770; 210/774

[58] Field of Search ..... 210/748, 180, 181, 774, 210/770, 179; 110/250, 346, 229, 230, 231, 250, 268, 275, 285, 118, 101 CD; 219/10.55 A, 10.55 R; 426/241; 34/1 S, 1 T, 1 V, 1 P, 135

[56] References Cited

U.S. PATENT DOCUMENTS

| | | | |
|---|---|---|---|
| 1,887,490 | 11/1932 | Imhoff | 210/179 |
| 3,506,407 | 4/1970 | Keith | 210/180 |
| 3,700,565 | 10/1972 | Cornish et al. | 210/744 |
| 3,831,288 | 8/1974 | Stribling et al. | 210/748 |
| 3,974,075 | 8/1976 | Saigh et al. | 210/181 |
| 4,044,696 | 8/1977 | Marincek | 210/774 |
| 4,087,921 | 5/1978 | Blok | 34/1 S |
| 4,168,418 | 9/1979 | Bird | 210/748 |
| 4,180,718 | 12/1979 | Hanson | 219/10.55 A |
| 4,184,959 | 1/1980 | Marmo | 210/179 |
| 4,219,415 | 8/1980 | Nassef et al. | 210/748 |
| 4,320,002 | 3/1982 | Ihara | 210/178 |
| 4,582,629 | 4/1986 | Wolf | 210/748 |
| 4,631,133 | 12/1986 | Axelrod | 210/774 |
| 4,655,146 | 4/1987 | Lemelson | 110/346 |
| 4,778,605 | 10/1988 | Anthoney et al. | 210/770 |
| 4,818,405 | 4/1989 | Vroom et al. | 210/770 |
| 4,834,874 | 5/1989 | Anthoney et al. | 210/179 |
| 4,835,354 | 5/1989 | Collins et al. | 219/10.55 R |
| 4,947,769 | 8/1990 | Whitfield | 110/248 |
| 4,995,972 | 2/1991 | Kramer et al. | 210/180 |
| 5,037,560 | 8/1991 | Gayman | 210/748 |

FOREIGN PATENT DOCUMENTS

| | | |
|---|---|---|
| 44947 | 3/1982 | European Pat. Off. . |
| 2022227 | 12/1979 | United Kingdom . |

*Primary Examiner*—Robert A. Dawson
*Assistant Examiner*—Sun Uk Kim
*Attorney, Agent, or Firm*—Rogers, Howell & Haferkamp

[57] ABSTRACT

An apparatus and method for the efficient removal of hazardous and nonhazardous volatile and semi-volatile organic materials from contaminated materials includes an evaporation/vacuum heating chamber that communicates with a microwave generator, a vacuum pressure system, a contaminated material in-feed system, and a residue removal system. The evaporation/vacuum heating chamber is fed with successive batches or a continuous supply of contaminated material and subjects the contaminated material to microwave energy and vacuum pressure to draw off volatile and semi-volatile material from the contaminated material as vapor and reduce the contaminated material to a dry residue. The vapors are drawn from the chamber by the vacuum pressure system and are condensed and collected. The dried material residue is removed from the chamber by the residue removal system and is also collected for later disposal or reuse. The apparatus operates continuously or in a batch mode, with contaminated materials being fed into the apparatus simultaneously with the distilled vapor and dried residue being removed from the chamber.

31 Claims, 3 Drawing Sheets

STEAM SOURCE
CONTAMINATED MATERIAL SOURCE
RETURN TO COOLING MEDIUM
SOURCE OF COOLING MEDIUM

FIG. 3.
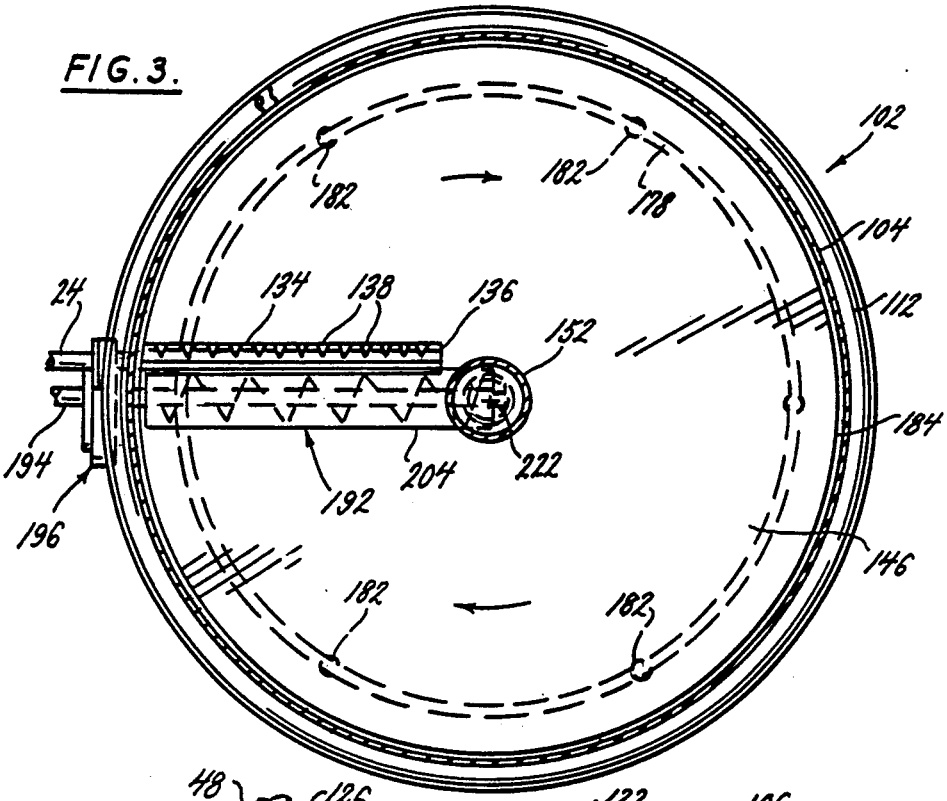
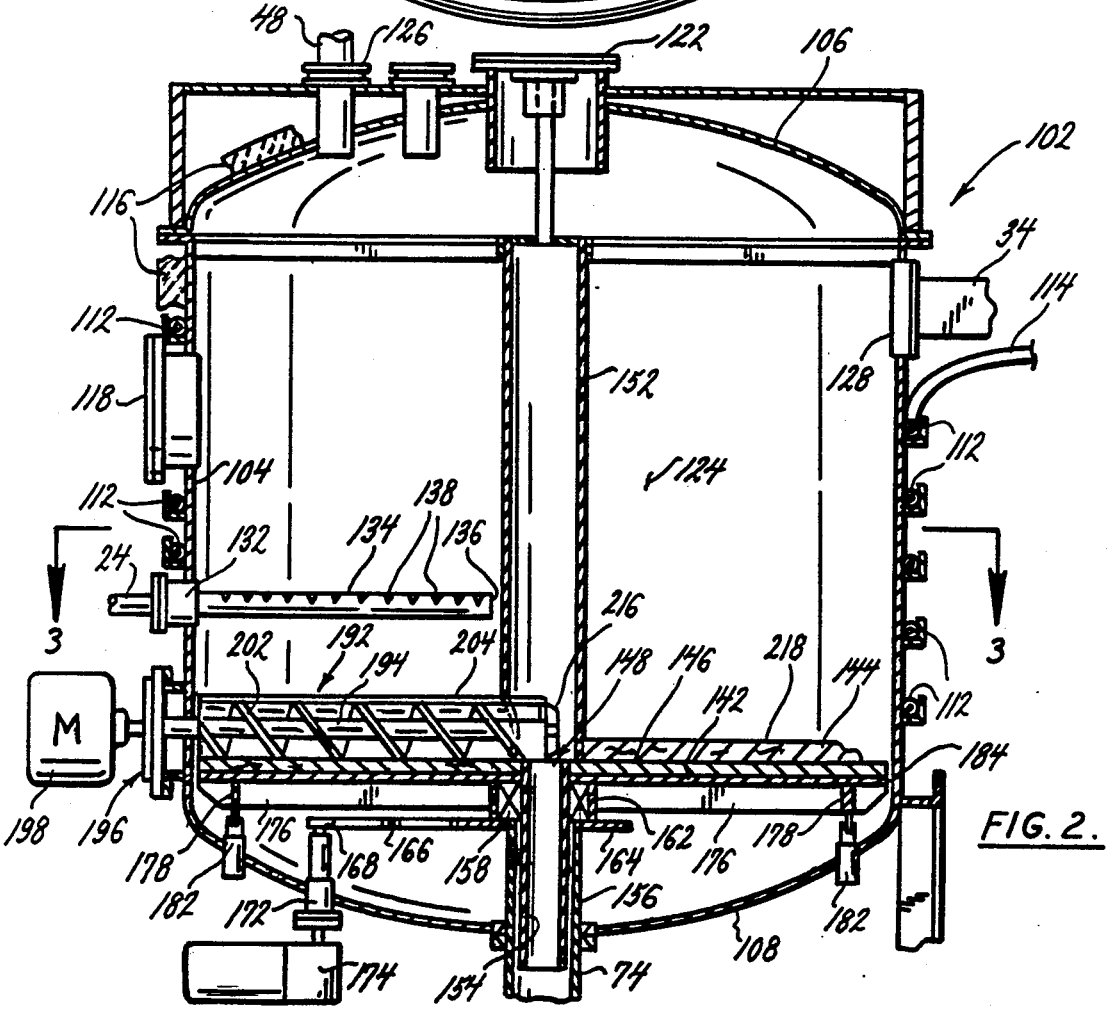
FIG. 2.

ROTATING MICROWAVE CONTAMINATED MATERIALS TREATING APPARATUS AND METHOD OF USING THEREOF

BACKGROUND OF THE INVENTION (1) Field of the Invention

The present invention pertains to an apparatus and method for the efficient separation of hazardous or nonhazardous volatile organic compounds (V.O.C.) from contaminated materials, and/or the elimination of harmful pathogens in contaminated materials. By hazardous volatile organic compounds (V.O.C.) what is meant is volatile and semi-volatile organic compounds having hazardous characteristics including, but not limited to, flammability, toxicity and/or carcinogenicity. By nonhazardous volatile organic compounds what is meant is volatile and semi-volatile materials that do not exhibit hazardous characteristics. The apparatus of the present invention is also useful in destroying harmful pathogens in contaminated materials such as hospital waste.

In particular, the present invention pertains to an apparatus that continuously receives contaminated materials while simultaneously subjecting the contaminated materials received to microwave energy and vacuum pressure. By subjecting the contaminated materials to microwaves and vacuum pressure, the apparatus extracts the hazardous V.O.C. and/or nonhazardous V.O.C. from the contaminated materials as a vapor, and thereby reduces the remaining materials to a dry residue. The apparatus also destroys harmful pathogens in contaminated materials by subjecting the materials to microwaves. In addition, the present invention pertains to the method involved in using the subject apparatus to separate hazardous V.O.C. or nonhazardous V.O.C. from a continuous supply of contaminated materials by thermal desorption, and the method involved in using the subject apparatus to destroy harmful pathogens in contaminated materials.

(2) Description of the Related Art

It is common practice in industry to use significant amounts of solvents and other volatile organic compounds (V.O.C.) in a variety of manufacturing process applications that often result in generating various different types of process by-products in the form of contaminated materials, both hazardous and nonhazardous. These contaminated material by-products contain semivolatile solvents such as alcohols, ketones, chlorinated solvents, aliphatic or aromatic materials, terpenes, glycol ethers, esters, glycols, hydrocarbons or water, some of which are reusable if recovered . Examples of solids contained in contaminated materials include paint pigments, resins, phenolics, photoresists, silica, metallic oxides and other solid particulates. Contaminated materials are produced in the aerospace, automotive, appliance, electronics, paint, coatings, film, textile, manufacturing and other related industries. In addition, soils contaminated with various volatile and semi-volatile organic compounds are often waste products of industrial sites.

It is also a frequent occurrence in the medical or health care industry that waste materials disposed of are contaminated with harmful pathogens. One example of these harmful pathogens is the human immunodeficiency virus (HIV), or the AIDS virus.

Industries that generate these and other contaminated materials are finding it increasingly difficult to dispose of the hazardous contaminated materials or recover reusable components of the materials without the outlay of considerable expense. Moreover, the indiscriminate dumping of hazardous contaminated materials, the increasing number of polluted landfills, the contamination of ground water, the potential for the release of toxic fumes from material storage sites and the resulting air pollution, and the increased occurrences of employee injury or infection resulting from the handling of hazardous contaminated materials and the liability of the contaminated materials producer despite their precautions, all add to the growing problem of the safe disposal of hazardous contaminated materials.

What is needed to resolve this problem is an efficient contaminated material treatment system that substantially separates the hazardous material content of contaminated materials and hence eliminates the hazardous characteristics such as flammability, toxicity, and/or carcinogenicity of the remaining material residue, and a system that substantially destroys harmful pathogens contained in contaminated waste materials, making the material residue or treated waste material eligible for disposal in normal landfills not specifically designated for hazardous materials or for other regulation suitable disposal methods.

To meet this need, the present invention provides a contaminated materials treating apparatus and method of operating the apparatus that substantially eliminates the hazardous materials and/or recovers reusable materials from contaminated materials.

SUMMARY OF THE INVENTION

The rotating microwave contaminated materials treating apparatus of the present invention is generally comprised of an evaporation/vacuum heating chamber, a microwave generator communicating with the chamber, a vacuum pressure system communicating with the chamber, a contaminated materials feed system communicating with the chamber, and a residue removal system communicating with the chamber.

The evaporation/vacuum heating chamber is basically a cylindrical housing completely enclosing a sealed volume. The interior walls of the chamber are impervious to microwaves. The chamber includes a horizontal, circular platform located toward the bottom of the chamber volume. The platform is mounted for rotation in the chamber about a center vertical axis of the platform. In a preferred embodiment of the invention, a top surface of the platform is covered with a refractory material or other suitable materials that are pervious to microwaves. In some applications of the invention, the refractory surface may not be needed. The refractory material provides a refractory surface above the surface of the platform that serves as a standoff from the reflective metal platform surface. The dielectric properties of the refractory material significantly shorten the wavelength of microwaves. The platform has a circular opening at its center, and a microwave choke is provided between the peripheral edge of the platform and the interior walls of the chamber.

The microwave generator communicating with the chamber provides microwave energy to the interior volume of the chamber. The microwave generator is located at a distance from the chamber to provide a safe environment in the area of the chamber when evaporating flammable solvents from contaminated materials supplied to the chamber. In other applications of the invention where nonflammable contaminated materials are treated by the apparatus, the microwave generator may interface directly with the heating chamber. The microwave generator is communicated with the chamber by a waveguide that leads from the generator to the chamber and terminates at a microwave transmitting window in a side wall of the chamber. The window is formed from a material that is transparent to microwave energy, yet is strong enough to withstand the difference in force between the atmospheric pressure acting on the waveguide side of the window and the reduced vacuum pressure on the chamber interior volume side of the window. The input of microwave energy into the chamber interior is dependent upon the mass transfer rate of the contaminated materials present in the chamber interior during the supply of contaminated materials through the chamber, the dielectric constant of the contaminated materials, and the microwave dissipation characteristics of the solids of the contaminated materials. The microwave generator is provided with a system of controls to adjust the intensity of the microwaves supplied to the chamber interior volume based on the above factors.

The vacuum pressure system communicating with the chamber is generally comprised of a condensate tank, a vacuum pump and a condenser connected to the chamber housing by a series of conduits. The chamber interior volume is evacuated by the vacuum pump, which evacuates both air and solvent vapors produced by heating the contaminated materials from the chamber interior volume. The condensate tank provides an enclosed environment for the safe capture of both hazardous and nonhazardous vapors evaporated from the contaminated materials. The vacuum pressure system also performs the secondary function of maintaining an equilibrium operation condition within the chamber interior volume by withdrawing the solvent vapors from the chamber volume as they are produced, thereby maintaining a desired vacuum pressure in the chamber volume which is inert and incapable of supporting combustion, the particular pressure being dependent on the contaminated material's composition. The preferred pressure ranges between 50 and 100 torr. The vacuum pressure system allows the vapors to condense in the condenser outside the chamber, and removes the condensed solvent distillate from the condenser against atmospheric air pressure, thereby creating and preserving the reduced pressure of the container interior volume. The distilled solvent is collected in the condensate tank for later disposal or reuse.

The contaminated materials feed system is generally comprised of a materials dispenser inside the evaporation chamber that is fed with either successive batches or a continuous supply of contaminated materials from a supply of contaminated materials outside the chamber. The contaminated materials dispenser is mounted on an interior side wall of the chamber and extends radially into the chamber and over the platform. The dispenser deposits contaminated materials supplied to it onto the refractory surface of the platform as the platform rotates in the chamber interior beneath the dispenser.

The residue removal system is generally comprised of a residue removing auger inside the evaporation chamber and a residue holding tank below the center of the rotating platform. The residue removing auger is mounted on an interior side wall of the chamber and extends radially into the chamber and over the platform. The auger is formed with a central rotating shaft and at least one blade spiraling around the shaft in screw threat fashion. The spiraling blade is elevated a small distance above the refractory surface of the platform and a discharge end of the auger extends out over the platform center opening. A conduit extends downward from the platform center opening to the residue holding tank. Pressure locks, provided at the top and the bottom of the residue holding tank, are alternately opened and closed to provide access to the holding tank and to empty the holding tank without effecting the pressure of the chamber interior volume.

In operation of the rotating microwave contaminated materials treating apparatus, contaminated material is supplied from the external source of the material to the material dispenser inside the heating chamber. The material dispenser deposits the supplied contaminated material onto the refractory surface of the platform as the platform rotates inside the chamber interior volume. As the deposited contaminated material is rotated around the center axis of the platform, it is subjected to microwaves supplied to the interior volume of the chamber by the microwave generator, while simultaneously being pressure system communicating with the chamber.

The microwave heating excites the solvent molecules within contaminated materials containing volatile organic compounds (V.O.C.), causing the volatile organic compounds within the contaminated material and the contaminated material itself to increase in temperature. As the contaminated material is rotated by the platform, the temperature continues to increase in the chamber interior until the solvents contained in the contaminated material are brought to their boiling point at the reduced operating pressure of the chamber interior and vaporized. In contaminated materials such as hospital wastes, the microwave heating of the contaminated material destroys any harmful pathogens present in the material.

The solvent vapors created by subjecting the material contaminated with V.O.C. to microwave energy and vacuum pressure are withdrawn from the interior of the chamber by the vacuum pressure system communicating with the chamber. The solvent vapor is condensed in the condenser of the vacuum pressure system and is collected in the condensate tank for later disposal or reuse. The process continues to subject the contaminated material to microwave energy and vacuum pressure, volatizing the components of the contaminated material and inducing vaporizational stripping of the solvent from the contaminated material, leaving a resultant cake of treated material residue dry and virtually free of volatile matter. In some applications, the treated residue is dried down to 100 parts V.O.C. per billion of treated residue. The process of drying the contaminated material preferably takes place in less than one complete revolution of the chamber platform. However, some applications may require multiple revolutions of the chamber platform to completely dry the contaminated material.

As the platform continues to rotate, the treated material residue approaches the residue removing auger of the removal system. As the platform rotates beneath the auger, the rotating spiral blade of the auger scrapes the dried material residue from the refractory surface of the platform and moves the dried residue toward the center opening of the platform. The auger pushes the dried residue into the center platform opening and the residue falls through the conduit communicating the operating with the residue holding tank where the residue is collected. The auger continues to move the dried material residue into the holding tank until the tank is filled to a predetermined level. At this point, the upper pressure lock of the tank is closed and the bottom pressure lock of the tank is opened to permit the dried material residue collected in the tank to be removed from the tank while maintaining the vacuum pressure in the chamber.

In this manner, the rotating microwave contaminated materials treating apparatus of the present invention continuously reduces hazardous or nonhazardous contaminated materials supplied to the apparatus to a dried cake of residue that may be disposed of in approved solid waste landfills or by other acceptable disposal means, or may be reused in some applications depending on the contaminated materials treated.

BRIEF DESCRIPTION OF THE DRAWINGS

Further objects and features of the present invention are revealed in the following detailed description of the preferred embodiment of the invention and in the drawing figures wherein:

FIG. 2 is a side elevation view, in section, of the rotating microwave waste materials drying apparatus of the present invention;

FIG. 3 is a plan view, in section, of the rotating microwave waste materials drying apparatus taken along the line 3—3 of FIG. 2;

DESCRIPTION OF THE PREFERRED EMBODIMENT

Figure 1:
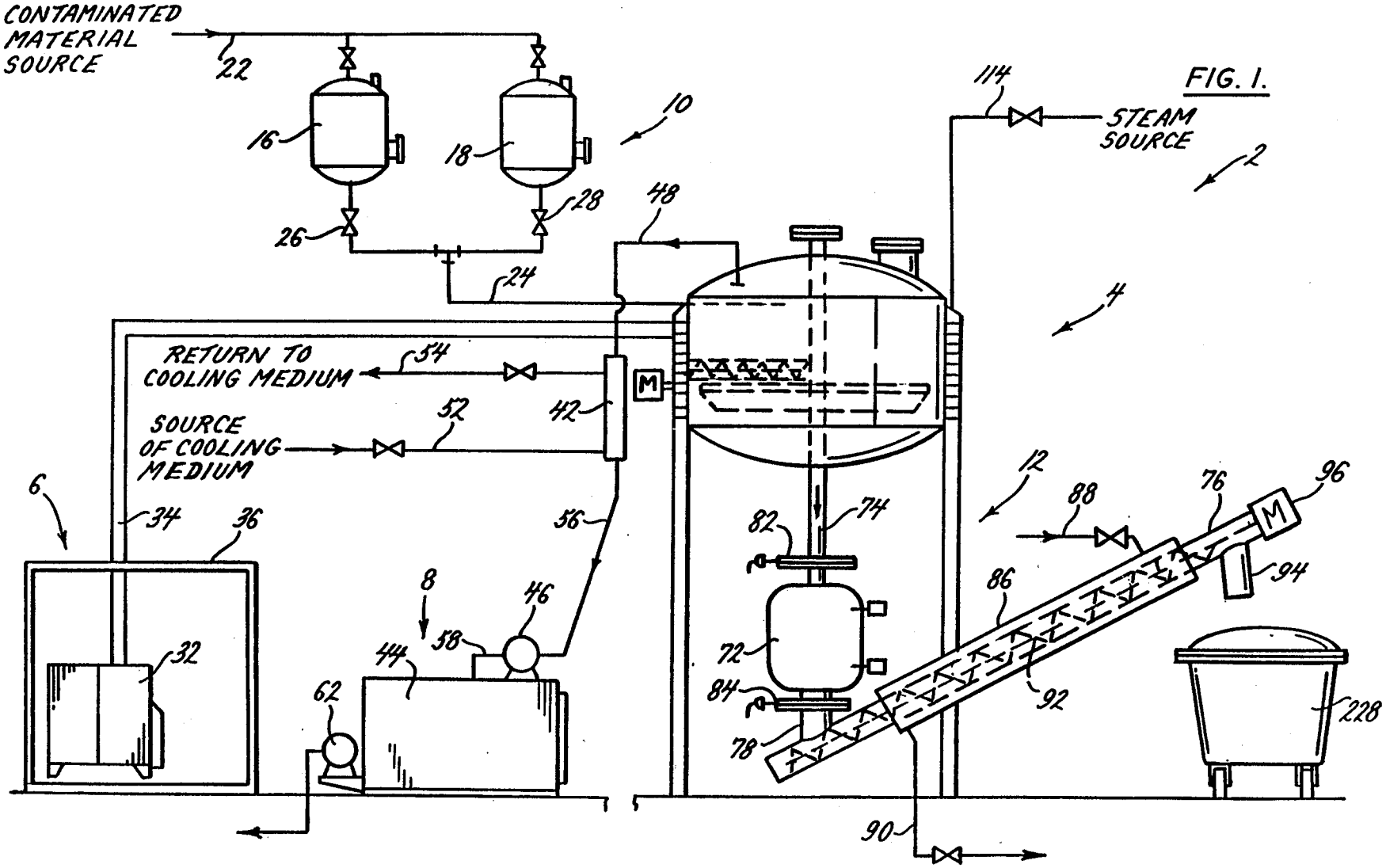
FIG. 1 shows schematic representation of a microwave waste materials drying system employing the rotating microwave waste materials drying apparatus of the present invention.

FIG. 1 shows a microwave contaminated materials treating system 2 employing the rotating microwave contaminated materials treating apparatus 4 of the present invention. The system also includes a microwave generating system 6, a vacuum pressure system 8, a contaminated materials continuous in-feed system 10, and a residue continuous removal system 12, all communicating with the contaminated materials treating apparatus 4.

The contaminated material continuous in-feed system shown in the drawing figures is only one example of an in-feed system. In-feed systems will vary, depending on the type of contaminated material to be treated by the apparatus of the invention. The in-feed system shown will supply contaminated material in a continuous stream to the apparatus. In other applications of the invention, the in-feed system may have to be modified to supply successive batches of contaminated wasted to the apparatus. In applications where the contaminated material to be treated is granular or nugget shaped and will not flow, or in applications where the contaminated material is solid waste such as hospital gauze or syringes or other medical waste, the in-feed system will have to employ a conveying system other than that shown to supply the contaminated material to the apparatus of the invention. It should be understood that the particular in-feed system shown is only one example of different infeed systems that may be employed with the invention and it is not intended to be limiting.

The contaminated material continuous in-feed system shown includes a source of either hazardous or non-hazardous volatile organic material or contaminated material that communicates with a pair of holding tanks 16, 18 through a supply conduit 22. The holding tanks 16, 18 alternately communicate with a feed line 24 through a pair of alternately actuated valves 26, 28. The feed line 24 communicates a continuous supply of contaminated material from the pair of holding tanks 16, 18 to the rotating microwave contaminated materials treating apparatus 4 of the invention.

The microwave generating system 6 includes a microwave generator 32 that communicates with the rotating microwave contaminated materials treating apparatus 4 through a wave guide 34. The microwave generator 32 is shown located remote from the treating apparatus 4 and enclosed in a control room 36. This arrangement safely distances the source of microwave energy from the treating apparatus when the apparatus is used to distill flammable solvents from a contaminated material sample. In applications of the invention where nonflammable contaminated materials are treated by the apparatus, the microwave generator may interface directly with the heating chamber and there is no need for enclosing the generator in a separate control room. The microwaves produced by the generator 32 generally have a frequency of 915 MHz or 2,450 MHz, these being the frequencies allocated by the Federal Communications Commission for commercial microwave heating operations. The input of microwave energy into the rotating microwave contaminated materials treating apparatus 4 is dependent on the mass of the contaminated material being supplied to the apparatus, the amount of liquid in the contaminated material, the dielectric constant of the contaminated material, and the microwave dissipation characteristics of the solids of the contaminated material. The microwave generator 32 is provided with a system of controls (not shown) used to adjust the intensity of the microwaves supplied to the treating apparatus 4 based on these factors. The field strength of the microwaves supplied to the apparatus 4 is maintained below a level at which ionization and glow discharge occurs, compensating for a vacuum pressure maintained in the interior of the contaminated materials treating apparatus 4.

The vacuum pressure system communicating with the microwave contaminated materials treating apparatus 4 is comprised of a counterflow heat exchanger or condenser 42, a condensate tank 44, and a vacuum pump 46. The condenser 42 communicates with the interior of the rotating contaminated materials treating apparatus 4 through a length of conduit 48. Counterflow condensers of the type employed in the present invention are known in the prior art and are generally comprised of a sealed housing with straight tubes (not shown) extending through the housing interior. The tubes communicate with a separate source of liquid cooling medium through an input conduit 52 and an outlet conduit 54. The separate source of the liquid cooling medium pumps a cooling liquid such as water through the input conduit 52, the condenser 42, and back out through the output conduit 54 where the cooling medium is returned to its source. A length of conduit 56 is connected between the condenser 42 and the vacuum pump 46, and an additional length of conduit 58 communicates the vacuum pump 46 with the condensate tank 44. A second pump 62 is provided in fluid communication with the condensate tank 44 and is used for periodic draining of the V.O.C. condensate from the tank.

The residue continuous removal system 12 shown in the drawing figures is only one example of a residue removal system to be used with the apparatus of the invention. Other removal systems employing pneumatic conveyors, belt conveyors, drag chains, etc., may be substituted for the removal system shown depending on the type of contaminated material treated by the apparatus. The particular removal system shown is illustrative only and is not intended to be limiting.

The residue continuous removal system 12 shown in the drawing figures communicating with the rotating contaminated materials treating apparatus 4 is comprised of a residue holding tank 72 that communicates with the materials treating apparatus 4 through a length of conduit 74, and a screw auger conveyor 76 that communicates with the residue holding tank 72 through an additional length of conduit 78. A pneumatic dump valve 82 is positioned between the upper conduit 74 and the residue holding tank 72, and a second pneumatic dump valve 84 is positioned between the residue holding tank 72 and the second length of conduit 78 leading to the conveyor 76. A water cooling jacket 86 surrounds the screw auger conveyor 76 and communicates with a cooling water supply input 88 and a water supply output 90. The screw auger conveyor 76 is provided with a rotating spiral blade 92 extending through its interior. Rotating the spiral blade 92 transports materials deposited into the conveyor from the lower conduit 78 through the conveyor 76 to an output conduit 94. The spiraling auger is rotated by an auger motor 96 provided on the conveyor 76.

The rotating microwave contaminated materials treating apparatus 4 is shown in detail in FIG. 2 of the drawings. The apparatus is generally comprised of a sealed evaporation chamber 102 having a cylindrical side wall 104 and concave top and bottom walls 106, 108. The side wall 104 and top and bottom walls 106, 108 are impervious to microwaves and together define a sealed pressure chamber.

A fluid trace 112 surrounds the side wall 104 of the chamber. The trace 112 is supplied with a heated fluid, such as hot water or hot oil, through a conduit 114 communicating with a separate source of the heated fluid. The heated fluid conducted through the trace 112 prevents condensation from forming on the exterior of the chamber side wall 104. The side wall 104 and top wall 106 of the chamber, along with the fluid trace 114, are covered in a layer of insulation 116.

A pair of sealed manways 118, 122 extend through the chamber side wall 104 and top wall 106, respectively. The manways provide access to the chamber's interior volume 124. A connector 126 extends through the top wall 106 of the chamber and communicates the chamber interior 124 with the vacuum pressure evacuator/condenser conduit 48.

A microwave window 128 is provided in the chamber side wall 104 communicating the microwave waveguide 34 with the chamber interior volume 124. The window 128 is formed from a material that is transparent to microwave energy and is strong enough to withstand the difference in force between the atmospheric pressure acting on the waveguide side of the window and the reduced vacuum pressure in the interior volume of the chamber.

An additional connector 132 is provided in the chamber side wall 104 communicating the contaminated material in-feed line 24 with a material dispenser 134 that projects into the chamber interior volume 124 from its mounting to the chamber side wall 104. The dispenser 134 is a tubular member having a sealed distal and 136. A plurality of orifices 138 are provided in the side of the dispenser 134 and are spatially arranged along the length of the dispenser. The plurality of orifices 138 may be shaped in a variety of configurations, the particular configuration of the orifices being chosen to best suit the viscosity of contaminated material to be passed through the orifices.

The in-feed material dispenser 134 shown in the drawing figures is only one example of a material dispenser to be used in the material treating apparatus 4. The particular dispenser shown is for illustrative purposes only and is not intended to be limiting. For example, for dispensing viscous contaminated materials in the interior of the chamber 102, the dispenser 134 could be given the configuration of a weir trough with the orifices being formed as V-shaped notches cut into one side of the trough. This configuration would enable viscous contaminated materials to pass along the length of the dispenser and be emitted from the dispenser through the V-shaped notches. For less viscous contaminated materials, the dispenser could be given the configuration of a hollow tube such as that shown in the drawing figures, with the orifices having the configuration of circular holes in the side wall of the tube. The diameters of the orifice holes would be dependent on the viscosity of the waste materials to be emitted by the dispenser. In a still further embodiment of the dispenser, the dispenser could be given the configuration of a U-shaped trough having a motor driven auger with a spiraling blade extending through the trough for pushing granular or nugget shaped contaminated materials along the length of the trough and ejecting the materials from the trough.

A horizontal, circular platform 142 is mounted for rotation in the interior volume of the chamber 124. The platform 142 rotates around a central vertical axis of the chamber. The platform 142 is constructed of metal and, because the intensity of microwaves decreases within one wavelength of a metal surface and approached zero at the metal surface, the top surface of the platform 142 is covered with a refractory material 144 that is pervious to microwaves. The refractory material 144 provides a refractory surface 146 above the platform surface that serves as a stand-off from the reflective metal surface of the platform. The dielectric properties of the refractory material significantly shorten the wavelength of microwaves.

The platform is provided with a circular opening 148 at its center. A cylindrical tube 152 extends downward through the interior of the chamber 102 and surrounds the platform center opening 148, shielding the opening from microwaves. A second cylindrical tube 154 is secured in the center opening 148 of the platform 142 and depends downward from the platform. A third cylindrical tube 156 is secured to the bottom wall 108 of the chamber and extends upward from the bottom wall around the second tube 154 depending from the platform. The top end of the third tube 156 engages a bearing assembly 158 that surrounds the second cylindrical tube 154. The bearing assembly 158 and the third cylindrical tube 156 support the platform 142 for rotation in the interior volume of the tank 102.

The bearing assembly 158 is surrounded by a cylindrical sleeve 162 secured to the underside of the platform 142. A sprocket wheel 164 is secured to the bottom of the sleeve 162, and a chain 166 connects the sprocket 164 in driving engagement with a drive sprocket 168. The drive sprocket 168 is driven through a drive shaft 172 by a motor assembly 174 outside the chamber 102. Although not shown in FIG. 2, the motor assembly 174 is mounted stationary relative to the rotating waste materials treating apparatus 4. Through the chain drive connection, the motor 174 rotates the sprocket 164 which, in turn, imparts rotation to the platform 142.

The platform 142 is also provided with radial supports 176 and a circular support 178 secured to the underside of the platform. Bearing assemblies 182 engage in rolling engagement with the platform circular support 178 and support the platform in the area of its peripheral edge 184. A microwave choke (not shown) is provided between the peripheral edge 184 of the platform and the interior of the chamber side wall 104 to prevent microwaves from passing between the platform edge and the side wall.

Figure 4:
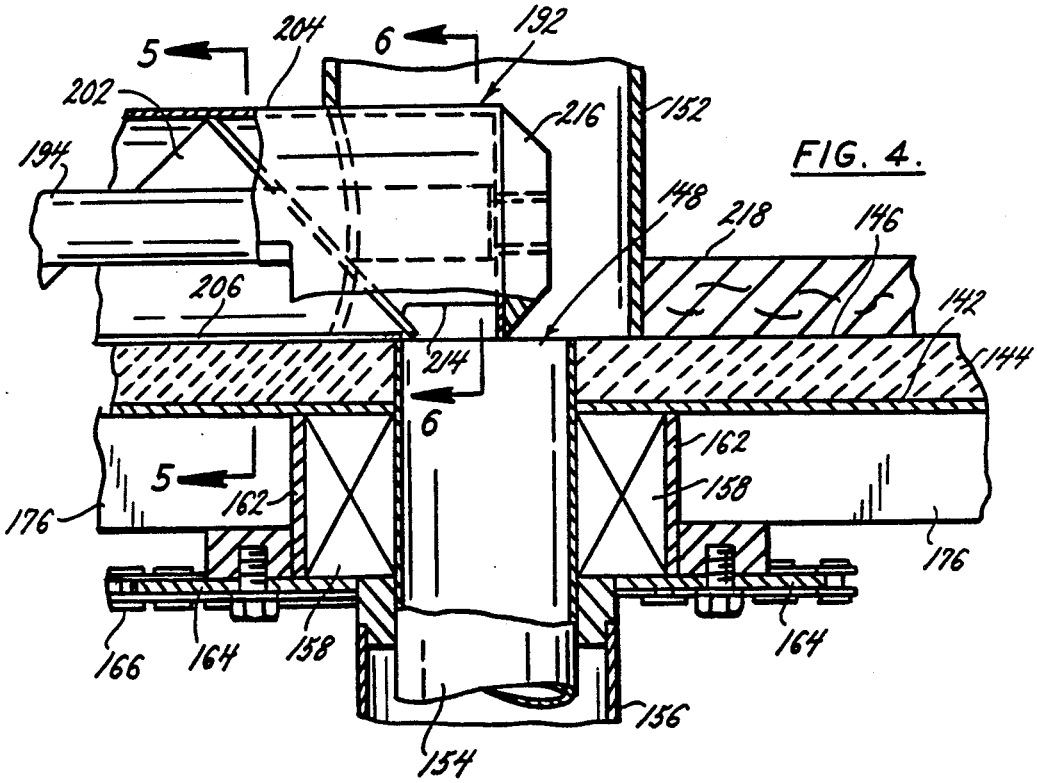
FIG. 4 is a segmented view, in section, showing the detail at the center of the microwave waste materials drying apparatus.
Figure 5:
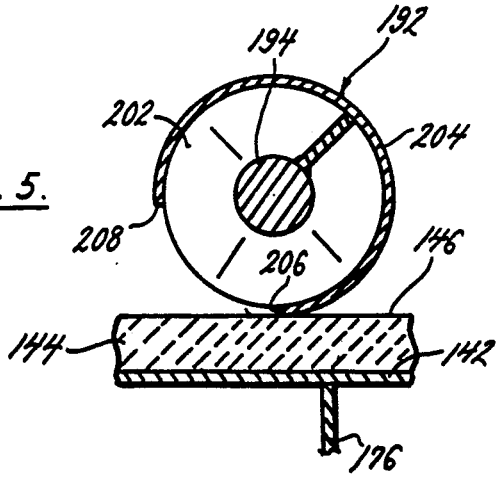
FIG. 5 is a segmented elevation view, in section, taken along the line 5—5 of FIG. 4.
Figure 6:
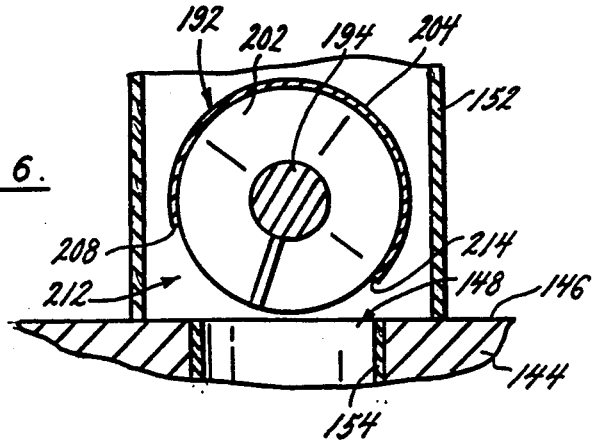
FIG. 6 is a segmented elevation view, in section, taken along the line 6—6 of FIG. 4.

A residue auger assembly 192 is mounted on the side wall 104 of the chamber 102 and extends into the interior of the chamber volume. The residue auger assembly 192 is comprised of a rotating auger having a central rotating shaft 194 that extends through the side wall 104 of the chamber and is supported in a bearing assembly 196 secured to an exterior surface of the chamber side wall. The auger shaft 194 is rotated by a motor 198 outside the tank side wall. Although not shown, the motor is secured to the rotating waste materials treating apparatus 4. The auger shaft 194 extends radially into the interior of the chamber 102 to a point just above the center opening 148 of the platform 142. As seen in FIG. 3, the auger shaft 194 is positioned just behind the waste materials dispenser 134. A blade 202 spirals around the length of the auger shaft 194 for almost the entire length of the shaft. A semi-cylindrical cowling 204 extends around about three quarters of the auger blade 202 circumference from the proximal end of the auger near the chamber side wall 104 to the distal end of the auger inside the cylindrical tube 152. The cowling has a longitudinal bottom edge 206 (see FIGS. 4 and 5) that scrapes along the top surface 146 of the platform refractory material 144, and a top edge 208 that is spaced a distance above the refractory material surface 146. The spacing between the bottom and top edges of the cowling defines an access opening 212 providing access to the rotating auger shaft 194 and blade 202 inside the cowling 204. A portion 214 of the cowling bottom edge is cut away at the discharge end of the cowling extending out over the platform center opening 148. The cut away portion 214 of the cowling enables materials conveyed by the rotating auger blade 202 toward the center opening 148 to fall through the opening from the auger assembly. An end cap 216 is secured to the discharge end of the auger shaft 194 to stop materials conveyed toward the platform center opening 148 by the rotating auger blade 202 and cause the conveyed materials to fall through the platform center opening.

In operation of the microwave contaminated materials treating system 2, the contaminated material holding tank valves 26, 28 are alternately opened and closed to communicate one of the two holding tanks 16, 18 with the feed line 24 leading to the microwave materials treating apparatus 4. By alternately communicating the waste holding tanks 16, 18 with the feed line 24, a continuous supply of contaminated material is conducted through the feed line 24 to the microwave materials treating apparatus 4.

The continuous supply of contaminated material passes through the feed line 24 to the material dispenser 134 in the interior of the evaporation chamber 102 of the treating apparatus. The contaminated material travels through the dispenser 134 to the dispenser end wall 136, and is emitted from the dispenser through the series of orifices 138. The contaminated material 218 ejected from the dispenser 134 falls from the dispenser and is deposited onto the refractory surface 146 of the rotating platform 142 forming a coating of contaminated material over the surface between the platform center opening 148 and peripheral edge 184.

The platform 142 is rotated by the sprocket and chain drive 164, 166, 168 connecting the platform to the motor 174. As the platform rotates clockwise around its center axis 222 as seen in FIG. 3, the contaminated material dispenser 134 continues to deposit contaminated material 218 onto the refractory surface 146 of the rotating platform. In this manner a continuous supply of contaminated material is deposited onto the refractory surface 146 of the platform and coats the surface of the platform as it rotates around the center axis 222.

As the coating of contaminated material 218 deposited onto the refractory surface 146 of the platform is rotated around the center axis 222 of the platform, it is subjected to microwaves generated by the microwave generator 32 and supplied to the interior volume 124 of the chamber 102 through the waveguide 34 and microwave window 128. Simultaneously, the coating of contaminated material 218 deposited on the rotating platform 142 is subjected to reduced vacuum pressure by the vacuum pressure pump 46 communicating with the chamber interior 124 through the connector 126, the conduit 48, the heat exchanger/condenser 42 and the conduit 56. The microwave heating of the contaminated material excites the water or solvent molecules within the material, causing the volatile organic compounds (V.O.C.) within the contaminated material and the material itself to increase in temperature. As the contaminated material is rotated by the platform 142, the temperature of the contaminated material continues to increase in the chamber interior 124 until the V.O.C. contained in the contaminated material are brought to their boiling point and vaporized at the reduced operating pressure of the chamber interior.

The V.O.C. vapors created by subjecting the contaminated material 218 to microwave energy and vacuum pressure are withdrawn from the chamber interior 124 by the vacuum pressure system communicating with the chamber. The V.O.C. vapors in the chamber interior 124 are drawn through the connector 126 and the conduit 48 to the counterflow heat exchanger/condenser 42 by the vacuum pump 46. In the heat exchanger/condenser 42, the V.O.C. vapors condense on the heat exchanger tubes (not shown) through which cooling water is recirculated. The cooling water is supplied from a separate source (not shown) through the inlet conduit 52, and returns to the source through the outlet conduit 54. As the V.O.C. vapors condense, the vapor pressure reduces, creating a vacuum in the heat exchanger/condenser 42 that becomes a motive force for drawing V.O.C. vapors from the chamber interior 124. The V.O.C. condensate then flows through the conduit 56 from the heat exchanger/condenser 42 to the vacuum pump 46 and the condensate tank 44. The V.O.C.

distilled and collected in the condensate tank 44 may be withdrawn from the tank through the pump 62 and conduit 64 and disposed of or reused if so desired. The process continues to subject the contaminated material 218 continuously supplied to the tank interior to microwave and vacuum pressure, volatizing the components of the contaminated material and inducing vaporizational stripping of the V.O.C. from the contaminated material, leaving a resultant cake of residue dry and virtually free of volatile matter. In the preferred embodiment, the treatment of drying the contaminated material takes place in less However, in variant embodiments of the invention, the entire drying treatment can take place during multiple revolutions of the platform.

As the platform 142 continues to rotate in a clockwise direction as shown in FIG. 3, the coating of dried material residue on the platform approaches the residue removing auger assembly 192. As the platform 142 rotates beneath the residue auger assembly 192, the bottom edge 206 of the assembly cowling 204 scrapes over the refractory surface 146 of the platform and removes the coating of dried material residue from the surface. As the platform continues to rotate, the material dispenser 134 deposits more contaminated material onto the portion of the platform refractory surface 146 just scrapped clean by the cowling of the auger assembly 192. The dried residue scraped from the refractory surface 146 moves up into the interior of the cowling 204 and is engaged by the spiraling blade 202 of the residue auger assembly. The spiraling blade 202 moves the dried residue radially toward the end cap 216 of the auger assembly. As the dried waste residue is moved to the conveyor assembly end cap 216, it falls through the cut away portion of the cowling 214 and the center opening 148 of the platform 142 and down through the center cylindrical tube 154 of the platform.

The platform center tube 154 directs the dried residue downward into the conduit 74 communicating the rotating contaminated materials treating apparatus 4 with the residue holding tank 72. With the upper pneumatic dump valve 82 open, the dried residue falls through the conduit 74 into the residue holding tank 72. The holding tank 72 is provided with a high level detector 224 and a low level detector 226. As the residue holding tank 72 fills with the dried residue, the height of the residue contained in the tank 72 increases until it is detected by the high level detector 224. When the residue has collected to this height, the detector automatically actuates the upper valve 82 causing it to close, and automatically actuates the lower valve 84 causing it to open. The opening of the lower valve 84 communicates the residue holding tank 72 with the conduit 78 leading to the water cooled removal auger assembly 76, and the waste material residue falls from the tank 72 into the auger assembly 76.

The rotating spiral blade 92 of the removal auger assembly 76 conveys the dried residue received from the residue holding tank 72 up along the length of the assembly to the assembly output 94 where the dried material residue is ejected from the assembly 76 into a refuge container 228 or some other facility for disposing of the residue or collecting the residue for reuse. When the residue holding tank 72 is emptied into the removal auger assembly 76, the absence of dried material residue in the holding tank 72 is sensed by the low level detector 226. This automatically actuates the lower valve 84 causing it to close, and automatically actuates the upper valve 82 causing it to open. This again establishes communication between the conduit 74 and the residue holding tank 72 so that dried material residue removed from the rotating contaminated material treating apparatus interior 124 is again collected in the residue holding tank 72.

In this matter, the rotating microwave contaminated materials treating apparatus of the present invention continuously reduces hazardous and nonhazardous contaminated materials supplied to the apparatus to a dried cake of residue that may be disposed of in approved solid waste landfills or by other acceptable regulated disposal means.

Although the functioning of the apparatus of the invention has been described above as drawing off volatile or semi-volatile organic compounds from contaminated materials to separate the contaminated materials into the volatile or semi-volatile organic compound condensate and a dried residue, it should be understood that this described procedure is illustrative only. The apparatus of the invention may be employed to perform a variety of processes including, but not limited to, separating volatile or semi-volatile compounds from solids in order to safely dispose of the organic compounds or solids, or to collect the organic compounds or solids for later reuse. Furthermore, the apparatus of the invention may be employed in heat treating wastes such as hospital wastes to destroy any harmful pathogens found in the wastes making the wastes safe for disposal. These are only a few examples of the processes that may be performed using the apparatus of the invention, these examples are not intended to be limiting.

While the present invention has been described by reference to a specific embodiment, it should be understood that modifications and variations of the invention may be constructed without departing from the scope of the invention defined in the following claims.

We claim:

1. An apparatus for the separation of volatile and semi-volatile material from non-volatile materials by thermal desorption, the apparatus comprising:

first means for enclosing a volume, the first means being impervious to microwave;

second means for transporting materials into the volume enclosed by the first means and then dispensing the materials from the second means inside the volume;

third means inside the volume enclosed by the first means for receiving the materials transported by and dispensed from the second means, and for transporting the materials received around a fixed vertical axis;

fourth means for subjecting the materials transported by the third means to microwave; and fifth means for subjecting the materials transported by the third means to a vacuum.

2. The apparatus of claim 1, further comprising:

sixth means for receiving from the third means materials that have been subjected to microwave by the fourth means and that have been subjected to a vacuum by the fifth means, and for removing the received materials from the volume enclosed by the first means.

3. The apparatus of claim 2, wherein:

the third means includes a circular, substantially horizontal platform having a peripheral edge and a center vertical axis, the platform is mounted for rotation about the vertical axis in the volume enclosed by the first means, and materials supplied by the second means into the volume are received on the platform and rotated about the vertical axis.

4. The apparatus of claim 3, wherein:

the sixth means includes a conveyor that extends over the platform from adjacent the center axis of the platform to adjacent the peripheral edge of the platform, the conveyor receives materials from the platform and conveys the received materials toward the center vertical axis of the platform.

5. The apparatus of claim 4, wherein:

the platform has a hole at its center concentric with the center vertical axis of the platform;

a residue holding tank communicates with the hole;

and the conveyor conveys materials from the platform to the hole at the center of the platform, and the hole conducts the materials conveyed to the hole to the residue holding tank, thereby removing materials from the volume enclosed by the first means.

6. The apparatus of claim 1, wherein:

the third means includes a means of supporting the materials received by the third means, and the means of supporting the materials has a refractory surface on which the materials are received.

7. The apparatus of claim 6, wherein:

the refractory surface is pervious to microwaves.

8. The apparatus of claim 7, wherein:

the refractory surface has a low dielectric loss factor.

9. The apparatus of claim 8, wherein:

the means of supporting the materials includes a platform that rotates about the fixed vertical axis, and the refractory surface overlays the platform.

10. The apparatus of claim 1, wherein:

the third means includes a platform that receives the materials supplied by the second means and rotates around the fixed vertical axis.

11. The apparatus of claim 10, wherein:

the platform has an axis of rotation that extends through the center of the platform and is perpendicular to the platform, and the platform axis of rotation is coaxial with the fixed vertical axis.

12. The apparatus of claim 10, wherein:

the platform has a refractory surface on which the materials are received, and the refractory surface is pervious to microwaves.

13. The apparatus of claim 1, wherein:

the third means includes a circular, substantially horizontal platform having a peripheral edge and a center vertical axis and mounted for rotation about the vertical axis in the volume enclosed by the first means.

14. The apparatus of claim 13, wherein:

the second means includes a dispenser that projects over the platform and deposits materials onto the platform in a line extending from adjacent the center axis of the platform to adjacent the peripheral edge of the platform.

15. The apparatus of claim 13, wherein:

the center vertical axis is coaxial with the fixed axis.

16. The apparatus of claim 15, wherein:

a refractory surface overlays the platform, and the refractory surface is penetrable by microwaves.

17. An apparatus for the separation of volatile and semi-volatile materials from non-volatile materials by thermal desorption, the apparatus comprising:

first means for enclosing a volume, the first means being impervious to microwaves;

second means for conveying materials into the volume enclosed by the first means and then depositing the materials from the second means into the volume;

third means inside the volume enclosed by the first means for receiving the materials conveyed and deposited in the volume by the second means, the third means being mounted inside the volume for rotation about a fixed vertical axis of rotation;

fourth means for supply microwaves to the volume enclosed by the first means and for subjecting the materials received by the third means to the microwaves; and fifth means for producing a vacuum in the volume enclosed by the first means and for subjecting the materials received by the third means to the vacuum.

18. The apparatus of claim 17, wherein:

the third means includes a platform that rotates around the axis of rotation, and the refractory surface overlays the platform.

19. The apparatus of claim 18, wherein:

the platform is a circular platform having a center and a peripheral edge, the axis of rotation extends through the center of the platform and is perpendicular to the platform, and materials deposited in the volume by the second means are received on the refractory surface overlying the platform and are transported by the platform around the axis of rotation.

20. The apparatus of claim 17, wherein:

the third means transports the materials deposited in the volume by the second means and received by the third means from a first location inside the volume to a second location inside the volume.

21. The apparatus of claim 20, wherein:

the third means includes a refractory surface that receives and supports the materials deposited in the volume by the second means, and the refractory surface is penetrable by microwaves.

22. The apparatus of claim 20, further comprising:

sixth means for removing from the third means the materials deposited in the volume by the second means and received by the third means, and for conducting the removed materials from the volume enclosed by the first means.

23. The apparatus of claim 22, wherein:

the third means receives materials deposited-in the volume by the second means at the first location inside the volume, and the sixth means removes materials from the third means at the second location inside the volume.

24. The apparatus of claim 23, wherein:

the third means includes a circular, substantially horizontal platform having a peripheral edge and a center vertical axis coaxial with the axis of rotation, the platform is mounted for rotation about the center axis and materials deposited into the volume by the second means are received on the platform at the first location and are rotated around the center axis by the platform to the second location.

25. The apparatus of claim 24, wherein:

the sixth means includes a conveyor that extends over the platform from adjacent the center axis of the platform to adjacent the peripheral edge of the platform, the conveyor engages materials on the platform at the second location and conveys the engaged materials toward the center axis of the platform.

26. The apparatus of claim 25, wherein:

the platform has a hole at its center, the conveyor extends over the hole, and the conveyor conveys the engaged materials into the hole.

27. The apparatus of claim 25, wherein:

the second means includes a dispenser that projects over the platform and deposits materials onto the platform at the first location in a line extending from adjacent the center of the platform to adjacent the peripheral edge of the platform.

28. An apparatus for the separation of volatile and semi-volatile materials from non-volatile materials by thermal desorption, the apparatus comprising:

a housing having an interior chamber and walls surrounding the chamber, the walls being impervious to microwaves;

a dispenser extending from a wall of the housing into the chamber for supplying materials into the chamber;

a platform mounted for movement inside the chamber and mounted to receive materials supplied into the chamber by the dispenser and move the materials received by the platform within the chamber;

a microwave generator operatively connected to the housing to supply microwaves to the housing chamber and subject the materials received by the platform to microwaves;

a pressure reducer operatively connected to the housing to supply vacuum pressure to the housing chamber and subject the materials received by the platform to vacuum pressure; and a conveyor extending from a wall of the housing into the chamber for removing materials received by the platform from the housing chamber.

29. The apparatus of claim 28, wherein:

a refractory surface overlays the platform, and the refractory surface is penetrable by microwaves.

30. A method of separating volatile and semi-volatile material from non-volatile materials by thermal desorption, the method including:

continuously supplying materials into an enclosed volume;

rotating the materials supplied in the enclosed volume around a fixed vertical axis;

subjecting the materials supplied into the enclosed volume to microwaves and vacuum pressure as the materials are rotating inside the enclosed volume; and continuously removing the materials from the enclosed volume after the materials have been rotated and subjected to microwaves and vacuum pressure.

31. In an apparatus for treating materials contaminated with pathogens and for destroying the pathogens, an improvement comprising:

first means for enclosing a volume, the first means being impervious to microwaves;

second means for supplying materials into the volume enclosed by the first means and for dispensing the materials from the second means into the volume;

third means inside the volume enclosed by the first means for receiving the materials supplied and dispensed by the second means, and for transporting the materials received around a fixed vertical axis; and fourth means for subjecting the materials transported by the third means to microwaves.

* * * * *